United States Patent [19]

Kochackis

[11] 4,418,551

[45] Dec. 6, 1983

[54] VENDING MACHINE SECURITY CAGE

[76] Inventor: Donald G. Kochackis, 95 E. Prospect St., Chula Vista, Calif. 92011

[21] Appl. No.: 280,729

[22] Filed: Jul. 6, 1981

[51] Int. Cl.[3] ..... E05B 13/00; E05B 17/14; E05B 67/38; E05C 19/18

[52] U.S. Cl. ..... 70/18; 70/78; 70/159; 70/164; 70/54; 70/427; 292/259 R

[58] Field of Search ..... 70/18, 15, 78, 77, 54–56, 70/423, 427, 424, 428, 158–164; 292/259 R

[56] References Cited

U.S. PATENT DOCUMENTS

| | | | |
|---|---|---|---|
| 109,330 | 11/1870 | Maddox | 292/259 R X |
| 127,794 | 6/1872 | Ransom et al. | 70/158 X |
| 695,656 | 3/1902 | Smalley | 70/164 X |
| 1,197,149 | 9/1916 | Percy | 70/423 |
| 1,206,611 | 11/1916 | Strode | 70/427 |
| 1,262,378 | 4/1918 | Neal | 70/164 |
| 1,330,672 | 2/1920 | Yonge | 70/18 |
| 2,716,882 | 9/1955 | Gill et al. | 70/159 |
| 2,904,986 | 9/1959 | Anderson | 70/78 |
| 3,399,553 | 9/1968 | Lehto | 70/158 |
| 3,537,548 | 11/1970 | Jeppesen | 70/18 X |
| 3,656,788 | 4/1972 | Emery | 292/259 R X |
| 3,665,736 | 5/1972 | Wilson | 292/259 R X |
| 3,762,191 | 10/1973 | Smith | 70/18 |
| 3,838,586 | 10/1974 | Tennison | 70/56 |
| 4,350,032 | 9/1982 | Kochackis | 70/427 |

FOREIGN PATENT DOCUMENTS

| | | | |
|---|---|---|---|
| 2410271 | 10/1974 | Fed. Rep. of Germany | 70/18 |
| 436924 | 4/1912 | France | 70/15 |
| 192777 | 2/1923 | United Kingdom | 70/18 |

*Primary Examiner*—Robert L. Wolfe
*Assistant Examiner*—Carl F. Pietruszka
*Attorney, Agent, or Firm*—Charmasson & Holz

[57] ABSTRACT

The cash box of a vending machine is protected by a heavy steel door or pair of doors which are locked across the front of the juke box covering the cash box, the door or doors being mounted on a framework consisting of steel straps which wrap around the back, and preferably the top and bottom as well, of the vending machine and interlock in such a way that they can be installed without screws, bolts or other fastening structure and will positively be locked into place when the barrier door or doors are closed. This configuration eliminates the need to mount a barrier door onto the vending machine, which is somewhat time consuming and tricky due to the strength of the mounting that is required.

5 Claims, 10 Drawing Figures

FIG. 4
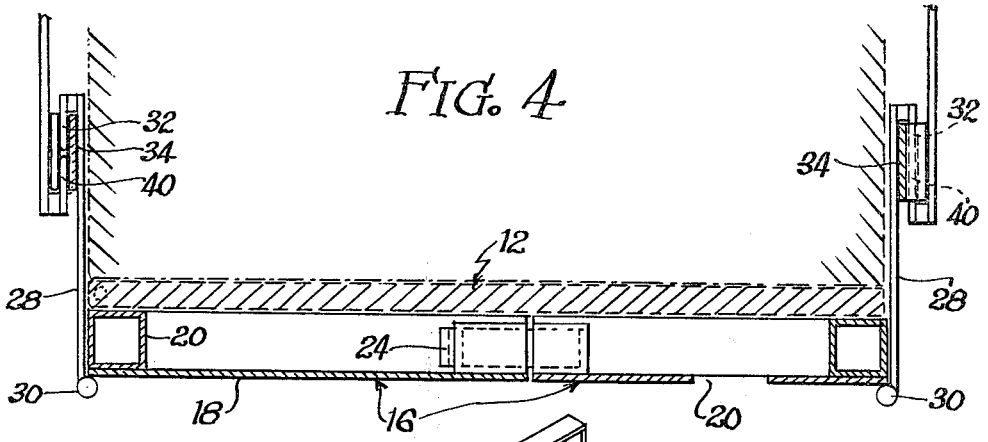
FIG. 5
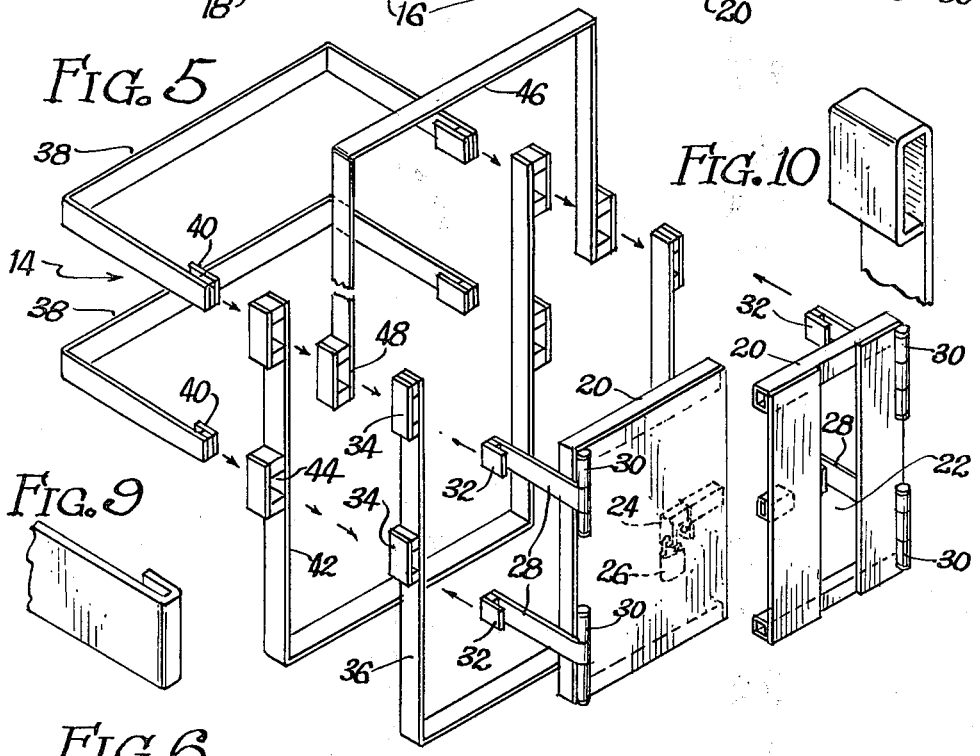
FIG. 10
FIG. 9
FIG. 6
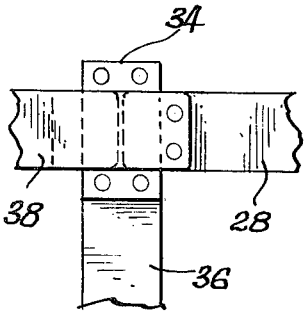
FIG. 7
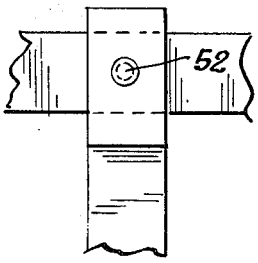
FIG. 8
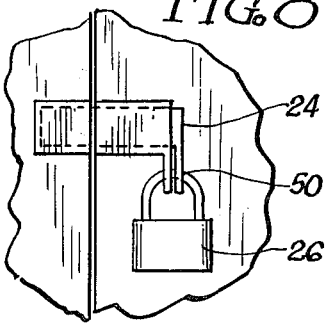

VENDING MACHINE SECURITY CAGE

BACKGROUND OF THE INVENTION

The invention is in the field of vending machine protectors. Vending machines, being exposed to the public, are frequently the victims of vandals and theives. Ordinarily, theives move quickly and violently. They do not bother to pick the lock of the cash box, but use a crowbar, or in some instances a very heavy pointed bar with which they smash through the front of the cash box. A protective cover such as a steel door will effectively deter this destructive criminal activity.

In my prior patent application, filed Aug. 25, 1980 and having Ser. No. 06/181,075, now U.S. Pat. No. 4,350,032 of Sept. 21, 1982, I provided a door with a frame having inside screws so that the frame could be screwed directly into the sheet metal of the vending machine. An interior lock is provided for the door which is accessible only by reaching the hand through a small hole in the front door and unlocking the lock in a somewhat awkward position, to eliminate the possibility of picking the lock.

Whereas this earlier invention is practical, it requires the rather extensive modification of existing vending machines through use of the screws and/or bolts necessary to mount the barrier door. Vending machine operators generally don't have time to make these modifications, and may in some instances be wary of marring the front surface of their vending machines in the event they later want to remove the barrier door.

There is a need, therefore, for a barrier door mounting system which securely supports the door across the cash box portion of the front of the vending machine, but does not require mounting bolts, screws, or other penetrating fasteners for its deployment.

SUMMARY OF THE INVENTION

The instant invention fulfills the above stated need by the provision of a set of straps engaged around the body portion of a vending machine in such a way that when the barrier door which passes across the front of the machine is locked in place, the interlocking strap elements are not disengageable. However, to install or remove the straps, it is a simple matter for the operator to open the barrier doors which permits the straps supporting the doors to move rearwardly, disengaging from the horseshoe-shaped strap around the back of the machine and enabling all of the strap elements to be dismantled or assembled around the machine body.

Not only are all mounting bolts and screws eliminated, but the interlocking nature of the straps eliminates the need for bolts or fasteners in the strap harness which encases the vending machine body.

BRIEF DESCRIPTION OF THE DRAWINGS

FIG. 4 is a section taken along line 4—4 of FIG. 1;

FIG. 5 is an exploded perspective showing the strap elements;

FIG. 6 is a detail of the hook engage structure;

FIG. 7 is a detail illustrating a slight modification of cross strap attachment;

FIG. 8 illustrates a modified locking arrangement;

FIG. 9 is a modified strap hook;

FIG. 10 is a modified sleeve.

DETAILED DESCRIPTION OF THE PREFERRED EMBODIMENT

Figure 1:
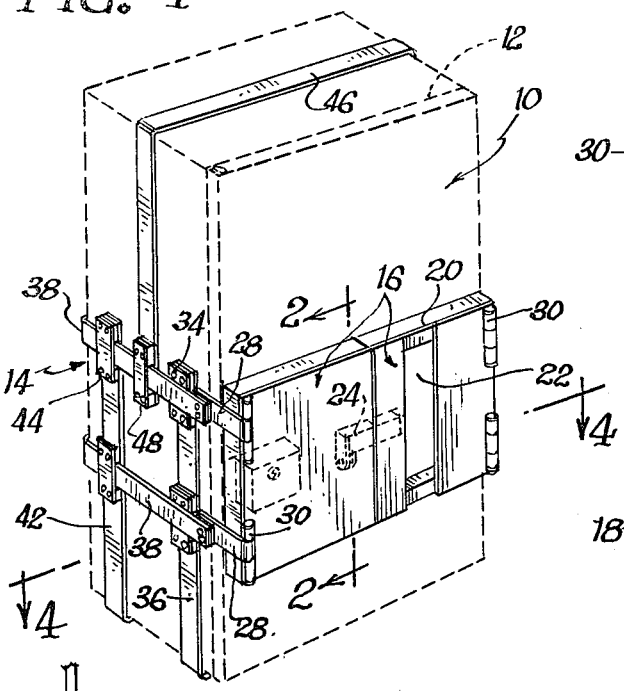
FIG. 1 is a perspective view of the barrier deployed, with a vending machine shown in phantom.
Figure 2:
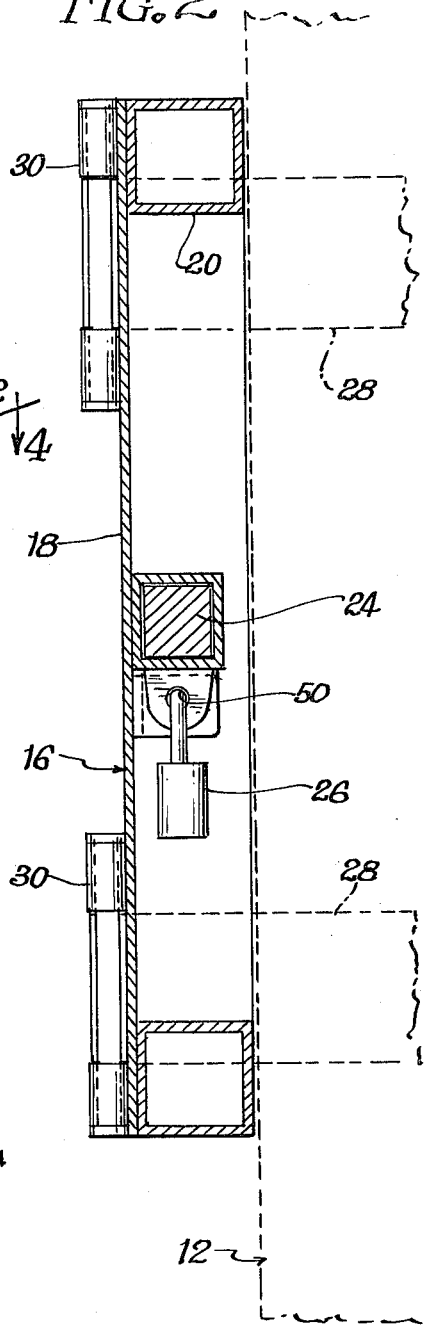
FIG. 2 is a section taken along line 2—2 of FIG. 1.

As shown in FIG. 1, a typical vending machine 10 is generally rectangular with a hinged front door 12 which covers the cash box and the rest of the interior of the machine. The invention comprises in general an interlocking strap network 14 which mounts a pair of swinging barrier doors 16. It is, of course, the general concept of the entire invention that the strap structure be interlocking such that when the doors 16 are open, the strap structure can be removed or put in place, but when they are closed as shown in FIG. 1, the structure is locked rigid and the individual strap elements can no longer be separated. Within this general concept, obviously there are a number of different ways of implementing the invention with different strap positioning, numbers of straps, and variations of the door design. Clearly, the illustrated embodiment is one of many falling within this general idea, and whereas it would obviously not be practical to describe all or many of the possible variations, it will be understood that these do exist, and the illustrated embodiment is exemplary only.

Turning to the details of the illustrated embodiment, it is, of course, a necessity that the front doors 16 be extremely strong. These doors each have a front panel 18 and a surrounding steel tubular frame 20. The right door has an access opening 22, and the doors are held together by a sliding lock bolt 24 secured with padlock 26. This solid steel lock bolt 24 is sufficiently strong, together with its sleeving and mountings, to prevent prying apart of the two doors with any reasonable force.

Figure 3:
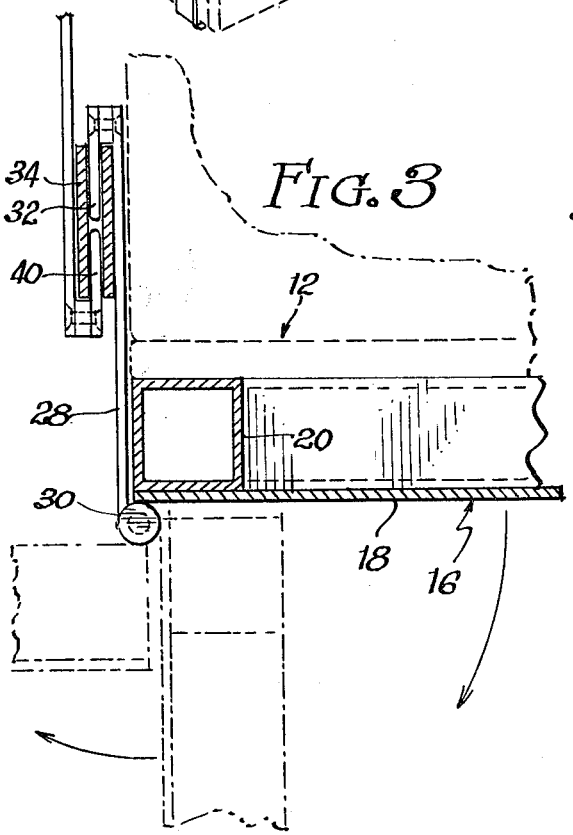
FIG. 3 is a horizontal section taken through the door hinge and surrounding structure.

Each of the doors is provided with a pair of short straps 28, which in turn define mounting positions for the hinges 30 at their forward ends. These short strap segments have returned end portions 32 which are engaged in the sleeves 34 of a vertical strap element 36. This engagement can be seen in FIG. 3, and the overall relation of the straps is best shown in FIG. 5. The short strap segments 28 are part of longer, horseshoe-shaped horizontal straps, the rear portions 38 also having forward hooked ends 40 which also engage the sleeves 34 as shown in FIG. 3. Thus, when thus engaged, a pair of horizontal straps are defined, which, taken together with the swinging doors 16, completely wrap around the vending machine. The sleeves 34 not only act to engage the hooks 40 and 34 together to remove the discontinuities established by the hooks in the horizontal strap elements, the sleeves additionally provide vertical support for the horizontal straps. Additional vertical support can be provided by the second vertical strap element 42 with its sleeves 44, and another vertical strap element 46 passing over the top of the machine and terminating in sleeves 48. The sleeves 48 and 44 must be large enough to pass the entire cross section of the hooks 40 therethrough. These hooks are shown in the principal embodiment as being made of bonded laminations, although the re-bent hook shown in FIG. 9 could be used as well. The comparable bent version of the sleeve is shown in FIG. 10, which could replace the laminar construction of the sleeves shown elsewhere. A modified lock using a pair of alignable eyelets 50 is shown in FIG. 8, and FIG. 7 illustrates the possibility of providing a bolt 52 at the cross junction of the straps to reinforce these members, if this proves necessary. A bolt could also eliminate the requirement for the sleeves 44 and 48, which could be replaced by one of the bolts.

Clearly, a single hinged door spanning the entire front of the vending machine could be implemented to replace the double hinge structure shown. In any event, all hinges must be plugged or capped so that the hinge pin is not exposed and cannot be driven out.

When installing the illustrated structure, all strap elements can be put in place with the exception of the strap segments 28 mounted to the doors. Once the other straps are in place, these strap segments can engage the sleeves 34, and once the doors are closed, the hooks 32 will be pulled forward to snugly engage the sleeves 34 as shown in FIG. 3. Clearly, other than the application of a tremendous amount of brute physical force, there is no way of disengaging the hooks 32 and 40 from the sleeves 34 in which they are engaged. Without the application of a single screw or bolt into the vending machine itself and without any bolts used to hold the frame members together, a secure barrier is provided for the front of the machine. Although this description and the claims contemplate that the case box is in the front of the machine as it usually is, clearly a slight modification of the instant invention would accomodate variant machines in which the cash box may be positioned elsewhere.

While I have described the preferred embodiment of the invention, other embodiments may be devised and different uses may be achieved without departing from the spirit and scope of the appended claims.

What is claimed is:

1. A protective barrier assembly for a vending machine cash box comprising:

(a) a strap structure engaged around portions of said vending machine and defining stable mounting positions adjacent the opposite sides of the vending machine front;

(b) a door mounted to one of said mounting positions, and being moveable between an open mode exposing the front of said vending machine and a closed mode protecting at least a portion of the front of said vending machine;

(c) means locking said door securely in the closed position;

wherein said door is one of two doors respectively hinged to said mounting positions and said locking means includes a bar passing behind both doors.

2. Structure according to claim 1 wherein at least one of said doors has a hand opening therethrough to permit access to said locking means.

3. A protective barrier assembly for a vending machine cash box comprising:

(a) a strap structure engaged around portions of said vending machine and defining stable mounting positions adjacent the opposite sides of the vending machine front;

(b) a door mounted to one of said mounting positions, and being moveable between an open mode exposing the front of said vending machine and a closed mode protecting at least a portion of the front of said vending machine, (c) means locking said door securely in the closed position;

wherein said strap structure includes a plurality of interlocking strap elements; and including a horizontal horseshoe-shaped strap mounting said door across its two front ends and defining discontinuities at the sides of said vending machine with interlocking ends such that closure of said door engages said interlocked ends and prevents their separation.

4. Structure according to claim 3 wherein the interlocked ends of said discontinuous horizontal strap engages respectively in sleeves defined by a vertical strap which passes from one sleeve to the other vertically along the sides of said vending machine and horizontally across a horizontal surface of said machine to provide vertical support to said horizontal strap.

5. A protective barrier assembly for a vending machine cash box comprising:

(a) a strap structure engaged around portions of said vending machine and defining stable mounting positions adjacent the opposite sides of the vending machine front;

(b) a door mounted to one of said mounting positions, and being moveable between an open mode exposing the front of said vending machine and a closed mode protecting at least a portion of the front of said vending machine;

(c) means interlocking said door securely in the closed position;

wherein said strap structure comprises:

(a) a plurality of strap elements variously extended over the top, bottom and rear of said vending machine; and (b) some of said straps defining sleeves at their respective ends with others of said straps passing through said sleeves.

* * * * *